US007213715B2

(12) United States Patent
Boily

(10) Patent No.: US 7,213,715 B2
(45) Date of Patent: May 8, 2007

(54) HOISTING APPARATUS FOR USE AT A MANHOLE

(76) Inventor: Jacques Boily, 5951 Chemin St-Pierre, Laterrière, Québec (CA) G7N 1Y1

( * ) Notice: Subject to any disclaimer, the term of this patent is extended or adjusted under 35 U.S.C. 154(b) by 0 days.

(21) Appl. No.: 10/508,645

(22) PCT Filed: Mar. 20, 2003

(86) PCT No.: PCT/CA03/00413

§ 371 (c)(1),
(2), (4) Date: Mar. 24, 2005

(87) PCT Pub. No.: WO03/078293

PCT Pub. Date: Sep. 25, 2003

(65) Prior Publication Data

US 2005/0161422 A1 Jul. 28, 2005

(30) Foreign Application Priority Data

Mar. 20, 2002 (CA) ..... 2377409

(51) Int. Cl.
*B66C 23/18* (2006.01)

(52) U.S. Cl. ..... 212/179

(58) Field of Classification Search ..... 212/179, 212/901

See application file for complete search history.

(56) References Cited

U.S. PATENT DOCUMENTS 1,650,656 A 11/1927 Sasgen
4,770,304 A * 9/1988 Woods ..... 212/348
5,022,489 A * 6/1991 Sauber ..... 182/3
5,152,506 A * 10/1992 Pickrell ..... 254/134.3 FT
5,445,487 A 8/1995 Koscinski, Jr. ..... 414/543
5,725,070 A * 3/1998 Eldred ..... 182/63.1
6,554,254 B2 * 4/2003 Vetesnik ..... 254/325
6,592,101 B2 * 7/2003 Vetesnik ..... 254/285
6,607,053 B1 * 8/2003 Warren ..... 182/106
6,644,342 B1 * 11/2003 Bogan et al. ..... 137/364
6,889,798 B2 * 5/2005 Overby et al. ..... 182/142

FOREIGN PATENT DOCUMENTS

| | | |
|---|---|---|
| EP | 0876989 | 11/1998 |
| FR | 918674 | 11/1946 |
| FR | 1557966 | 1/1969 |
| JP | 08318123 | 11/1996 |
| JP | 10159398 | 6/1998 |

* cited by examiner

*Primary Examiner*—Thomas J Brahan
(74) *Attorney, Agent, or Firm*—Mayer, Brown, Rowe & Maw LLP

(57) ABSTRACT

A hoisting apparatus (10) for use at a manhole (1), comprising a supporting mast and a jib crane (14) connected at an angle to an upper end portion (16) of the supporting mast (12). The jib crane (14) has a front member (18) pointing upwardly and extending on one side of the supporting mast (12) and a rear member (20) having a rear end section (22) extending on another side of the supporting mast (12). A linking rod (24) is connecting the rear member of the jib crane (14) to the supporting mast (12). The apparatus further comprises a winch mechanism (30) mounted onto the jib crane (14) and having a cable (32) cooperating with the front member (18) of the jib crane (14) for hoisting an object from the manhole (1). In a preferred embodiment, the apparatus comprise a security fence (40) for surrounding at least partially the manhole (1) and preventing accidental entry therein, the supporting mast (12) being part of the fence.

8 Claims, 4 Drawing Sheets

HOISTING APPARATUS FOR USE AT A MANHOLE

FIELD OF THE INVENTION

The present invention relates generally to the field of hoisting apparatuses and rescue assemblies. More particularly, it concerns a hoisting apparatus for use at a manhole or any confined space entry for rescue purposes or simply for lowering and raising a person or an object entering the hole.

BACKGROUND OF THE INVENTION

Manholes provide access to confined spaces or underground structures such as a sewer, boiler, drain or other similar structures. Often, people have to go into such confined spaces, with or without working material. They usually go into and come out of the manhole by means of a long ladder and a protective fence is usually erected around the opening of the manhole in order to prevent people that may pass thereby from falling into the manhole.

People working in manholes occasionally get seriously injured and, as a result thereof, require to be evacuated as quickly and as safely as possible from the manhole in order to be attended by a professional, such as a doctor and the like. The above-mentioned type of manhole-ladder assembly does not enable to quickly, easily, and safely evacuate an injured person from the manhole.

To that effect, tripod hoisting devices have already been developed for attaching a person entering a manhole so that he or she can be recovered in the event of any difficulties. These hoisting devices are also used for lowering and raising the working material necessary for the persons working in confined spaces. These tripod hoists are however cumbersome and once installed over the manhole, they interfere with persons or equipment being passed over the manhole. Examples of these prior art tripod hoists are given in the following US patents: U.S. Pat. No. 4,589,523; U.S. Pat. No. 4,660,679; U.S. Pat. No. 4,824,076.

Also known in the art are the hoisting apparatuses disclosed in U.S. Pat. No. 5,725,070 and U.S. Pat. No. 5,022,489 that are both designed to be secured to a manhole guardrail. These apparatuses are however also cumbersome and, as for the tripod hoists, they extend right over the manhole once installed, thereby interfering with persons or equipment being passed over the manhole. They are thus not very practical for an easy and rapid use.

There is also U.S. Pat. No. 4,838,439 which discloses a hoist apparatus comprising a swivel arm connected to a base member mountable over a manhole. The swivel arm is composed of a vertical post portion and a jib portion. The jib portion is rigidly connected to the post portion and extends upwardly and outwardly therefrom at an angle to the horizontal. A winch is mounted to the post. One drawback with this hoist apparatus is that it is fragile and not suitable for hoisting very heavy persons or objects. It has been shown that the joint connecting the jib portion to the post is not sufficient to resist to the flexion caused by the load hanging at the extremity of the jib portion.

Thus, there is still a need for a hoisting apparatus which would be easily and quickly mountable in the vicinity of a manhole while allowing also to lift very heavy objects or persons without interfering with persons or equipment being passed over the manhole.

SUMMARY OF THE INVENTION

An object of the present invention is to provide a hoisting apparatus for use at a manhole that satisfies the above-mentioned needs.

In accordance with the present invention, that object is achieved with a hoisting apparatus comprising a supporting mast and a jib crane connected at an angle to an upper end portion of the supporting mast. The jib crane has a front member pointing upwardly and extending on one side of the supporting mast and a rear member having a rear end section extending on another side of the supporting mast. The apparatus further comprises a linking rod having a first end connected to the rear end section of the jib crane and a second end connected to the supporting mast. A winch mechanism is mounted onto the jib crane. The winch mechanism has a cable cooperating with the front member of the jib crane for hoisting an object and/or a person from the manhole.

As can be appreciated, a hoisting apparatus according to the invention comprises very few elements, which makes it easy and quick to mount and fairly lightweight in order to facilitate transportation thereof, while being structurally sound, in order to safely support and evacuate a person from the manhole.

Also, such minimal amount of elements provide for an easy maintenance and/or part replacement thereof.

In accordance with a preferred embodiment, the hoisting apparatus comprises a security fence for surrounding at least partially the manhole and preventing accidental entry therein, the supporting mast being part of the fence.

The security fence which is preferably foldable comprises fence sections hingedly connected to one another. Also preferably, the fence sections are composed of substantially vertical structural posts joined together by framing members, the supporting mast being one of the substantially vertical structural posts.

In accordance with another preferred embodiment, the hoisting apparatus comprises a base support for vertically mounting the mast. The base support preferably comprises a female connector for removably receiving a bottom end of the mast.

It is also an object of the present invention to provide a hoisting apparatus for use at a manhole, comprising a security fence for surrounding at least partially the manhole and preventing accidental entry therein, the fence comprising fence sections composed of vertical posts joined together by framing members. The hoisting apparatus is characterized in that it further comprises a hoisting mechanism mountable onto one of the vertical posts, hereinafter referred to as the supporting mast, for hoisting an object from the manhole.

The hoisting mechanism preferably comprises a jib crane connected at an angle to an upper end portion of the supporting mast. The jib crane has a front member pointing upwardly and extending on one side of the supporting mast substantially over the manhole and a rear member having a rear end section extending on another side of the supporting mast. In this case, the apparatus further comprises a linking rod having a first end connected to the rear end section of the jib crane and a second end connected to the supporting mast. A winch mechanism is mounted onto the jib crane. The winch mechanism has a cable cooperating with the front member of the jib crane for hoisting an object and/or a person from the manhole.

BRIEF DESCRIPTION OF THE DRAWINGS

These and other objects and advantages of the invention will become apparent upon reading the detailed description and upon referring to the drawings in which.

Figure 1:
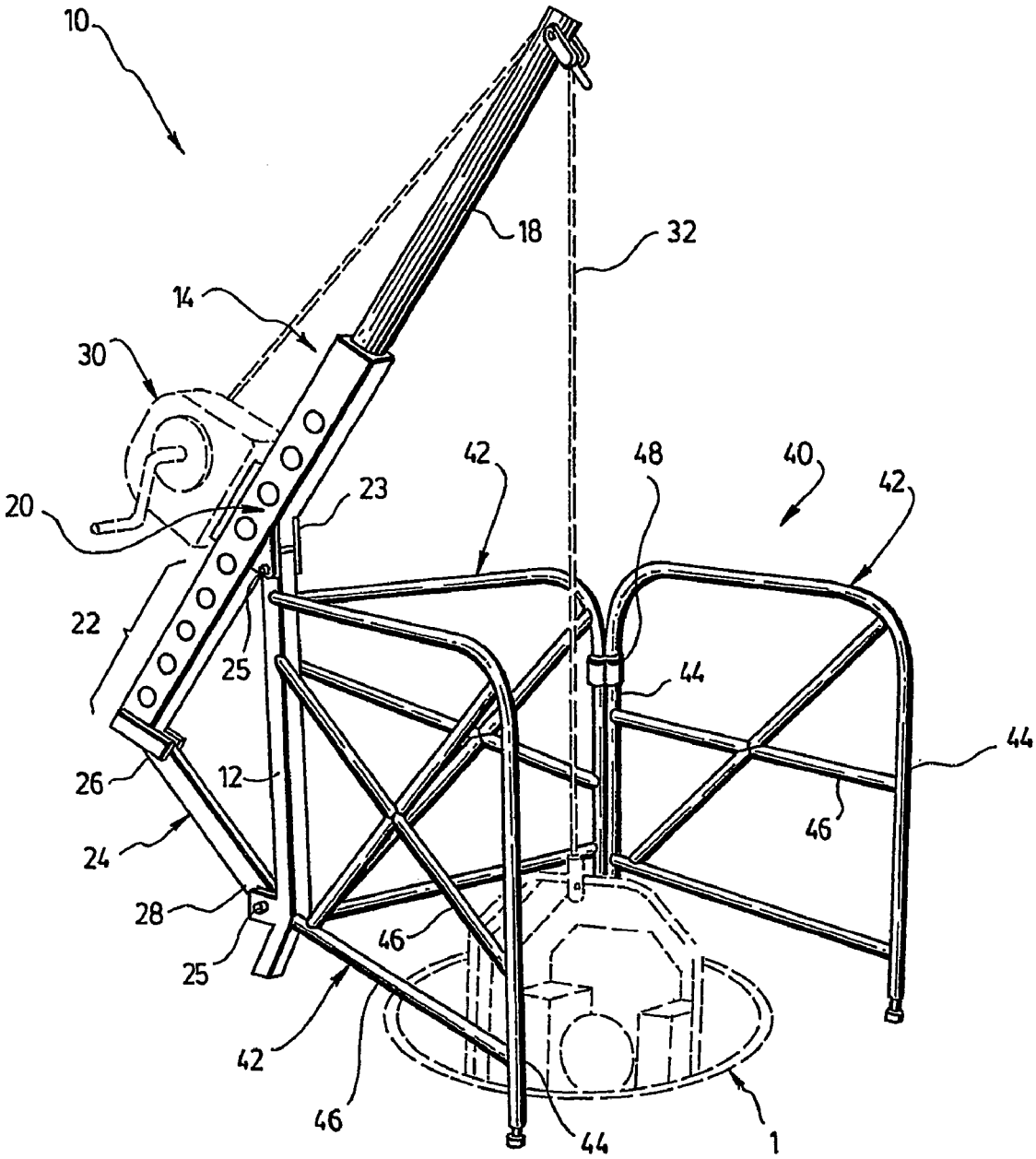
FIG. 1 is a perspective view of a hoisting apparatus according to a first preferred embodiment of the invention mounted in the vicinity of a manhole and showing a person being rescued with the apparatus.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF PREFERRED EMBODIMENTS

In the following description, similar features in the drawings have been given similar reference numerals and in order to lighten the figures, some elements are not referred to in some figures if they were already identified in a precedent figure.

Moreover, although the present invention was primarily designed for rescue purposes of individuals injured inside manholes so as to enable to evacuate them, it may be used for other applications and with other objects, such as a mining raise for example or for transportation of material, as apparent to a person skilled in the art. For this reason, the expressions "manhole", "person" and "rescue" should not be taken as to limit the scope of the present invention and include all other kinds of objects and purposes with which the present invention could be used and may be useful. For example, the expression "manhole" refers to any horizontally extending hole giving access to an underground confined space or structure such as a sewer, boiler, drain or other similar structure.

Figure 3:
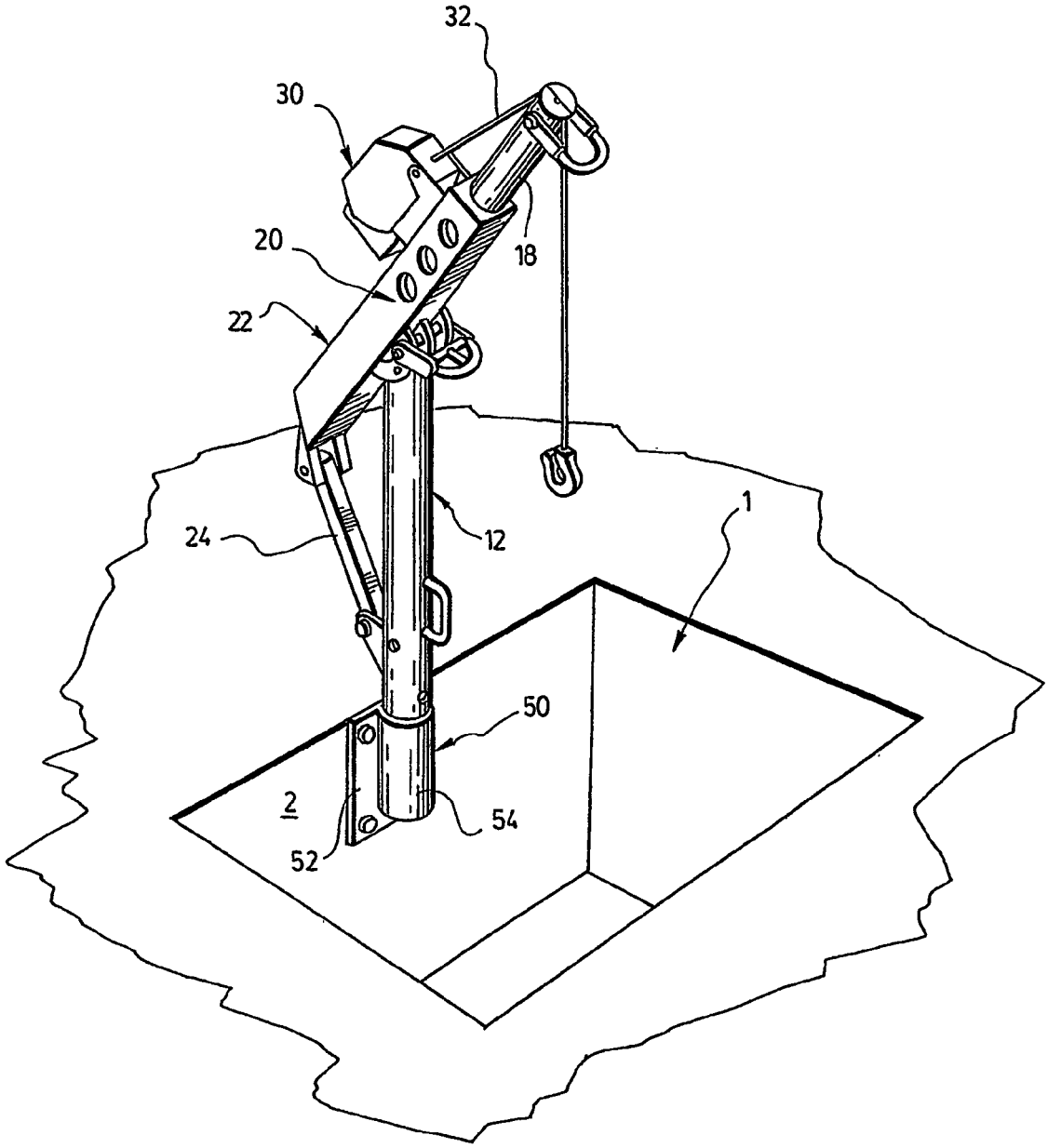
FIG. 3 is a perspective view of a hoisting apparatus according to a second preferred embodiment of the invention mounted to a square-shaped manhole.
Figure 4:
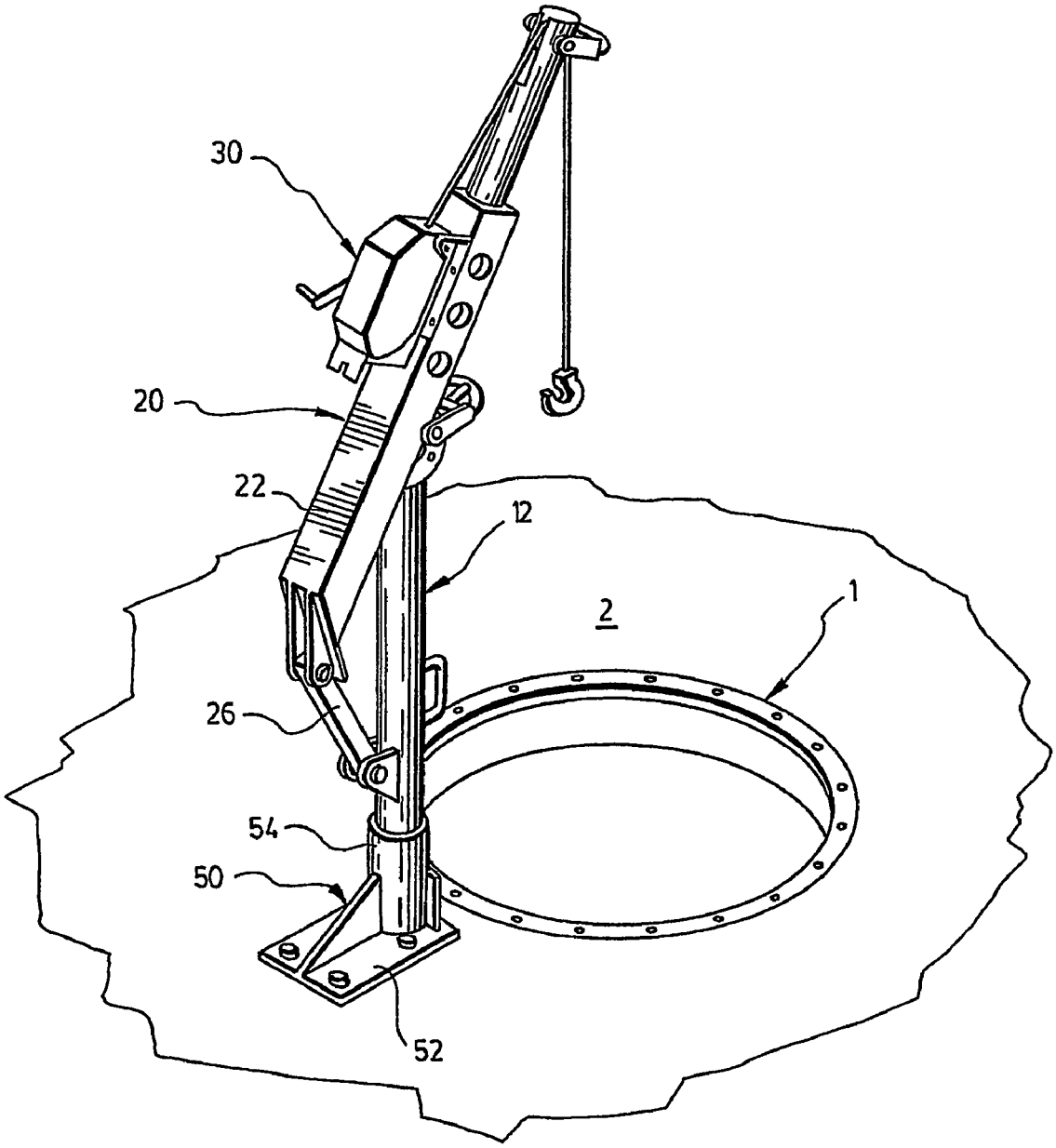
FIG. 4 is a perspective view of a hoisting apparatus according to a third preferred embodiment of the invention mounted in the vicinity of a round-shaped manhole.

Referring to either one of FIGS. 1, 3 and 4 and broadly described, the hoisting apparatus (10) according to the invention is suitable for use at a manhole (1) for raising and lowering objects and/or persons. It is thus very useful for rescuing purposes. The apparatus (10) comprises a supporting mast (12) and a jib crane (14) connected at an angle to an upper end portion (16) of the supporting mast (12). The jib crane (14) is composed of a front member (18) pointing upwardly and extending on one side of the supporting mast (12) and a rear member (20) having a rear end section (22) extending on another side of the supporting mast (12). The jib crane (14) which is preferably removably mountable onto the supporting mast (12) comprises a connector (23) on the rear member (20) adapted to removably receive the upper end of the supporting mast (12). The connector (23) may have the shape of a socket-type connector which receives the upper end of the mast (12). A conventional pin (25) can be used to secure the parts together.

In order to solidify the structure and make it suitable for hoisting heavy objects, the apparatus (10) further comprises a linking rod (24) having a first end (26) connected to the rear end section (22) of the rear member (20) of the jib crane (14) and a second end (28) connected to the supporting mast (12), preferably near the bottom end thereof. The apparatus (10) of the invention is preferably designed so as to enable to hoist an object or a person weighing up to about 300 pounds.

Preferably also, the first end (26) and the second end (28) of the linking rod (24) are removably connected to the rear member (20) and the supporting mast (12) respectively by means of pins (25).

A winch mechanism (30) is mounted onto the jib crane (14), preferably on the rear member (20) thereof. The winch mechanism (30) has a cable (32) cooperating with the front member (18) of the jib crane (14) for hoisting an object and/or a person from the manhole (1).

The rear member (20) is preferably sleeve-shaped and adapted to telescopically receive the front member (18) of the jib crane (14), thereby making it easy to adjust the length of the front member (18). Obviously in such a case, the apparatus (10) is provided with suitable locking means for removably locking the telescopic front member (18) in different positions. Suitable locking means are for example pins, screws or the like.

Although the supporting mast (12) and the front member (18) preferably have a circular cross section and the rear member (20) preferably has a square cross section as in the apparatuses illustrated, they may take any other shape as apparent to any person skilled in the art. For example, the rear member (20) could also have a circular cross section or all these elements may have a square cross section.

As can be appreciated, when a person is suspended at the end of the cable (32), the supporting mast (12) is put under a compression force while the linking rod (24) is put under a tension force. The load to which the apparatus (10) is subjected in supporting the weight is thus efficiently distributed in the structure, making it possible to suspend very heavy loads. The linking rod (24) thus helps reinforcing the resistance of the jib crane (14).

Figure 2:
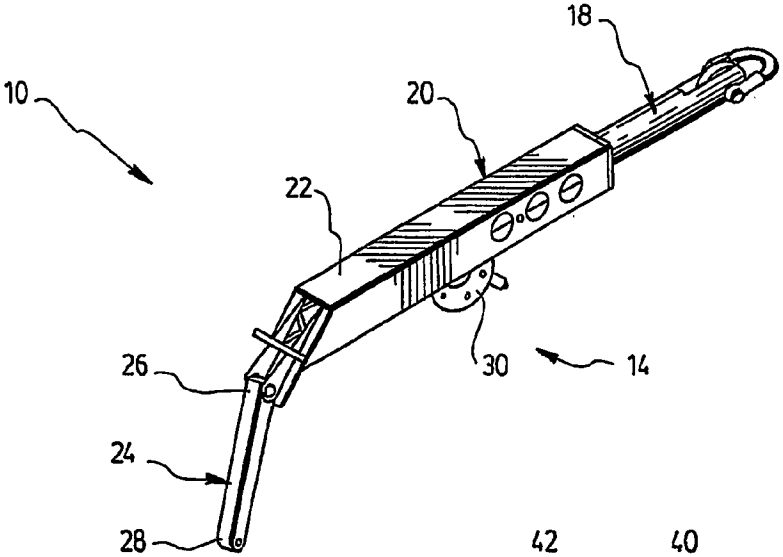
FIG. 2 is a perspective exploded view of a variant of the hoisting apparatus shown in FIG. 1.
Figure 2:
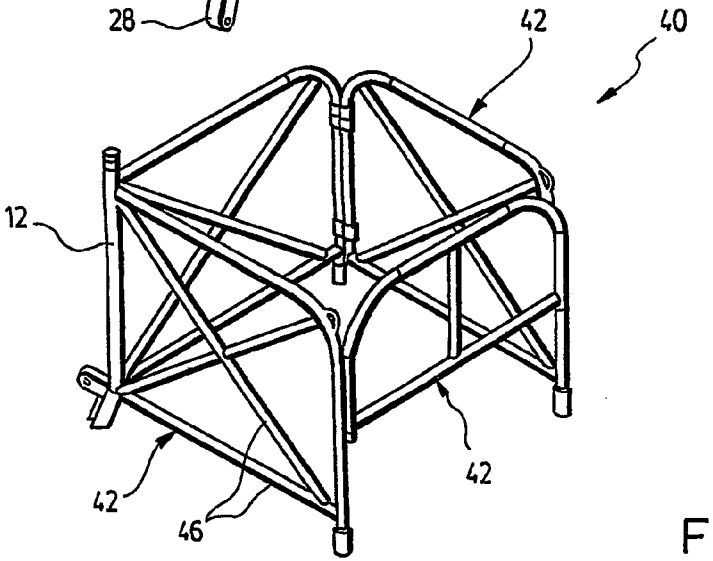

In accordance with a first preferred embodiment shown in FIGS. 1 and 2, the hoisting apparatus (10) comprises a security fence (40) for surrounding at least partially the manhole (1) and preventing accidental entry therein. As can be appreciated, the supporting mast (12) described above is one of the structural posts of the fence (40). In FIG. 1, the fence (40) is surrounding the manhole (1) partially, whereas the fence (40) shown in FIG. 2 encircles the manhole (1) completely. In both cases, the security fence (40), which is preferably foldable, comprises fence sections (42) hingedly connected to one another. The fence sections (42) are composed of vertical posts (44) joined together by framing members (46) such as horizontal rails and cross rails. It is however worth noting that any other type of framing members (46) such as boards and wires commonly used in the making of fences can be used without departing from the scope of the invention. The fence sections (42) are hindgely connected, preferably by means of metal collars (48) or any other means known in the art suitable for hingedly connecting vertical posts. Preferably also, the hoist mechanism (30) is removably connected to the jib crane (14) by means of pins for quick, easy and safe assembling and dismantling of the assembly. It is worth mentioning here that the above-mentioned components may be connected to their respective counterparts by other suitable connecting means, such as fasteners, sliding locks, and the like.

Referring now to FIGS. 3 and 4 and in accordance with another preferred embodiment, the hoisting apparatus (10) can be used without a fence. In such a case, the apparatus (10) comprises a base support (50) for vertically mounting the support mast (12). The base support (50) preferably comprises a female connector for removably receiving a bottom end of the mast (12). The base support (50) can take different shapes. Four of these different shapes are shown in FIGS. 3 to 6. In FIG. 3, the base support (50), which is adapted to be secured to a vertical wall (2), comprises a plate (52) and a tubular socket (54) sized to receive the bottom end of the mast (12). The tubular socket (54) is connected longitudinally to the plate (52). In FIG. 4, the base support (50) is adapted to be secured to a horizontal wall (4). In this case, the tubular socket (54) is connected at right angle to the plate (52).

Figure 5:
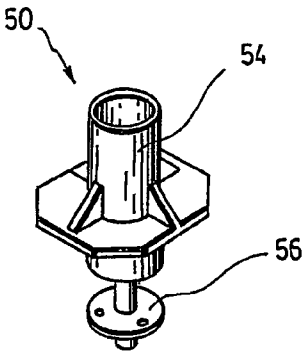
FIG. 5 is a perspective view of a base support that can be used with either one of the hoisting apparatuses shown in FIGS. 3 and 4.

The base support (50) shown in FIG. 5 is particularly suitable to be embedded in a concrete floor. In this case, the base support (50) is provided with an anchoring member (56) located under the tubular socket (54).

Figure 6:
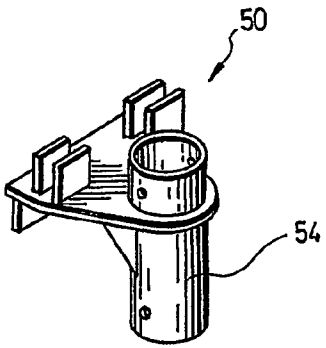
FIG. 6 is a perspective view of another base that can be used with either one of the hoisting apparatuses shown in FIGS. 3 and 4.

The base support (50) shown in FIG. 6 is adapted to be connected to the rim bordering the manhole of a transformer. In this case, and once the base support (50) is connected to the rim, the tubular socket (54) is in the void.

The components of the fence (40) and of the hoisting mechanism (30) are preferably made of suitable materials, as apparent to a person skilled in the art. Preferably, most of their components are made from a material selected from the group consisting of aluminum, stainless steel, acetal and aluminum composite.

As may now be appreciated, the present invention is an improvement and presents several advantages over the prior art in that, as described and explained herein, the hoisting apparatus (10) according to the present invention enables to quickly, easily, and safely evacuate an injured person from a manhole. Furthermore, the present invention is also advantageous in that, by virtue of its design and components, it may be easily and quickly mounted while allowing also to be easily dismantled for proper storage. Furthermore, the present invention is also advantageous in that its design enables it to be fairly lightweight, while being structurally sound in order to safely support and evacuate a person from the manhole. Furthermore, the present invention is also advantageous in that the interconnection of the components as described herein enables for easy maintenance and/or part replacement of the hoisting apparatus (10).

In addition, although the preferred embodiment of the present invention as illustrated in the accompanying drawings comprises various components such as pins, sockets, rods, etc., and although the preferred embodiment of the rescue assembly as shown consists of certain geometrical configurations as explained and illustrated herein, not all of these components and geometries are essential to the invention and thus should not be talken in their restrictive sense, i.e. should not be taken as to limit the scope of the present invention. It is to be understood, as also apparent to a person skilled in the art, that other suitable components and cooperations thereinbetween, as well as other suitable geometrical configurations, may be used for the fence and for the hoisting means of the rescue assembly according to the present invention without departing from the scope of the present invention.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A hoisting apparatus for use at a manhole, comprising:

a supporting mast;

a jib crane connected at an angle to an upper end portion of the supporting mast, the jib crane having a front member pointing upwardly and extending on one side of the supporting mast and a rear member having a rear end section extending on another side of the supporting mast;

a linking rod having a first end connected to said rear end section and a second end connected to the supporting mast;

a winch mechanism mounted onto the jib crane and having a cable cooperating with the front member of the jib crane for hoisting an object from the manhole; and a foldable security fence for surrounding at least partially the manhole and preventing accidental entry therein, said foldable security fence comprising a plurality of substantially vertical structural posts held together by framing members, said supporting mast being one of said plurality of substantially vertical structural post.

2. A hoisting apparatus according to claim 1, wherein said foldable security fence comprises fence sections hingedly connected to one another.

3. A hoisting apparatus according to claim 1, wherein said framing members are rails.

4. A hoisting apparatus according to claim 1, wherein the rear member is sleeve-shaped and the front member is telescopically mounted into the rear member.

5. A hoisting apparatus according to claim 1, comprising a socket connector on the rear member for removably receiving the upper end of the supporting mast.

6. A hoisting apparatus according to claim 1, comprising a base support for vertically mounting the mast.

7. A hoisting apparatus according to claim 6, wherein the base support comprises a socket connector for removably receiving a bottom end of the mast.

8. A hoisting apparatus according to claim 1, comprising pins for respectively and removably connecting the first end and the second end of the linking rod to the rear member and the supporting mast.

* * * * *